US010834994B2

(12) United States Patent
Garbujo et al.

(10) Patent No.: US 10,834,994 B2
(45) Date of Patent: Nov. 17, 2020

(54) CROSS-COUNTRY SKI BOOT SOLE

(71) Applicant: ROSSIGNOL LANGE S.R.L., Treviso (IT)

(72) Inventors: Giuseppe Garbujo, Montebelluna (IT); Giovanni Meneghini, Cassola (IT); Massimo Poloni, Montebelluna (IT)

(73) Assignee: ROSSIGNOL LANGE S.R.L., Treviso (IT)

( * ) Notice: Subject to any disclaimer, the term of this patent is extended or adjusted under 35 U.S.C. 154(b) by 514 days.

(21) Appl. No.: 15/410,527

(22) Filed: Jan. 19, 2017

(65) Prior Publication Data

US 2017/0208893 A1 Jul. 27, 2017

(30) Foreign Application Priority Data

Jan. 22, 2016 (EP) ..... 16425002

(51) Int. Cl.

| | |
|---|---|
| ***A43B 5/04*** | (2006.01) |
| ***A43B 13/14*** | (2006.01) |
| ***A43B 13/04*** | (2006.01) |
| ***A43B 13/16*** | (2006.01) |
| ***A43B 13/22*** | (2006.01) |
| ***A43C 15/16*** | (2006.01) |

(52) U.S. Cl.

CPC ..... *A43B 5/0413* (2013.01); *A43B 5/0411* (2013.01); *A43B 13/04* (2013.01); *A43B 13/141* (2013.01); *A43B 13/16* (2013.01); *A43B 13/223* (2013.01); *A43C 15/168* (2013.01)

(58) Field of Classification Search

CPC ... A43B 5/0411; A43B 5/0413; A43B 5/0421; A43B 13/41; A43B 13/28

USPC ..... 36/117.1, 117.2, 117.3, 15, 22 R, 124, 36/125, 134

See application file for complete search history.

(56) References Cited

U.S. PATENT DOCUMENTS

| | | | | | |
|---|---|---|---|---|---|
| 4,351,121 | A * | 9/1982 | Wallace | A63C 13/006 | 36/125 |
| 4,542,599 | A * | 9/1985 | Annovi | A43B 5/0419 | 36/117.4 |
| 5,088,756 | A * | 2/1992 | Hue | A63C 9/20 | 280/607 |
| 5,410,821 | A * | 5/1995 | Hilgendorf | A43B 1/0081 | 36/100 |
| 5,664,797 | A * | 9/1997 | Haughlin | A63C 9/20 | 280/615 |

(Continued)

FOREIGN PATENT DOCUMENTS

| | | |
|---|---|---|
| EP | 1 803 362 A1 | 7/2007 |
| EP | 2 732 715 A1 | 5/2014 |
| WO | 2013/058658 A1 | 4/2013 |

OTHER PUBLICATIONS

European Search Report and Written Opinion dated Jul. 20, 2016 issued in counterpart application No. EP16425002; w/ English partial translation and partial machine translation (12 pages).

*Primary Examiner* — Timothy K Trieu

(74) *Attorney, Agent, or Firm* — Westerman, Hattori, Daniels & Adrian, LLP

(57) ABSTRACT

Sole (20) for a sports shoe, notably for a cross-country ski boot, comprising a first component (1) acting as a framework and at least one second component (21) assembled with the first component (1), characterized in that the second component (21) comprises an anterior part (32) extending substantially longitudinally in the anterior part of the sole (20).

19 Claims, 6 Drawing Sheets

(56) References Cited

U.S. PATENT DOCUMENTS

| | | | | |
|---|---|---|---|---|
| 5,836,093 | A * | 11/1998 | Gallay | A63C 13/001 36/125 |
| 2005/0178024 | A1 | 8/2005 | Hauglin | |
| 2012/0117829 | A1 * | 5/2012 | Lawler | A43B 5/0419 36/132 |
| 2014/0115929 | A1 * | 5/2014 | Svensson | A43B 5/0486 36/117.3 |
| 2014/0325871 | A1 * | 11/2014 | Price | A43B 13/125 36/28 |
| 2016/0166003 | A1 | 6/2016 | Svensson | |

* cited by examiner

CROSS-COUNTRY SKI BOOT SOLE

This application claims priority of European application No. EP16425002.9 filed Jan. 22, 2016, whose content is hereby incorporated by reference herein in its entirety.

The invention relates to a sole of a cross-country ski boot and to a sports shoe as such incorporating such a sole. It also relates to a method of manufacturing such a sole and such a sports shoe.

A cross-country or even touring ski boot allows the boot to rotate about an axis situated towards the front of the boot. For that, it is provided with a sole which has high stiffness and strength, in order reliably to withstand attachment to the cross-country ski and contribute to the correct transmission of load during the practice of cross-country skiing. In particular, this sole needs to allow:

- maximum forward foot rolloff, in order to offer a long stride length in the practice of "traditional" or "classic style" cross-country skiing, which is characterized by a pronounced metatarsophalangial articulation; and
- optimal ski control in the practice of the alternative or skater's step, also widely known by its English name of skate style skiing, which demands maximum contact between foot and ski, for good control of the latter.

To complement this, such a cross-country ski boot needs to have minimal weight in order to optimize performance. Finally, it needs to guarantee the skier a satisfactory level of comfort, notably during the phases outside of skiing, such as walking. When faced with these contradictory requirements, the existing solutions remain unsatisfactory.

By way of example, document WO2013058658 addresses these requirements by describing a complex sole formed of the assembly of several components with complementing properties, notably a removable reinforcement in the central part of the sole. However, this solution remains expensive and is not optimal.

Thus, it is a first object of the present invention to propose a shoe sole which makes it possible to achieve sufficient stiffness, notably flexural and/or torsional stiffness, that it can be used for the practice of cross-country skiing.

It is a second object of the present invention to propose a shoe sole that offers minimal weight.

It is a third object of the present invention to offer a shoe sole that allows a satisfactory level of comfort to be achieved.

It is a fourth object of the present invention to offer a shoe sole that can be manufactured for a reasonable cost.

According to the concept of the invention, the shoe sole comprises a first component acting as a framework and at least one second component assembled with the first component, characterized in that the second component comprises an anterior part extending substantially longitudinally in the anterior part of the sole.

The invention is more precisely defined by the claims.

These objects, features and advantages of the present invention will be explained in detail in the following description of one particular embodiment illustrated by way of nonlimitation of a cross-country ski boot in conjunction with the attached figures in which:

FIGS. 1 and 2 respectively depict a perspective view from beneath and a view from beneath of a first component forming a framework of a sole according to one embodiment of the invention.

FIGS. 3 and 4 respectively depict a perspective view from beneath and a view from beneath of a second component forming an insert of the sole according to the embodiment of the invention.

FIGS. 5 and 6 respectively depict a perspective view from beneath and a view from beneath of a second component forming an insert of the sole according to an alternative form of the embodiment of the invention.

Figure 11:
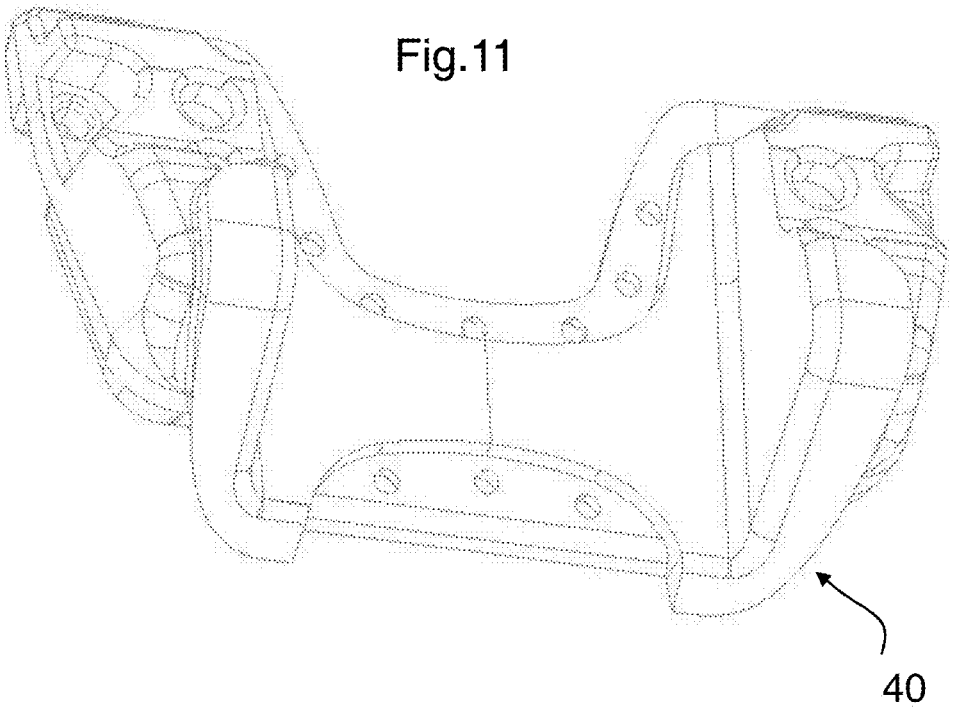
Figure 12:
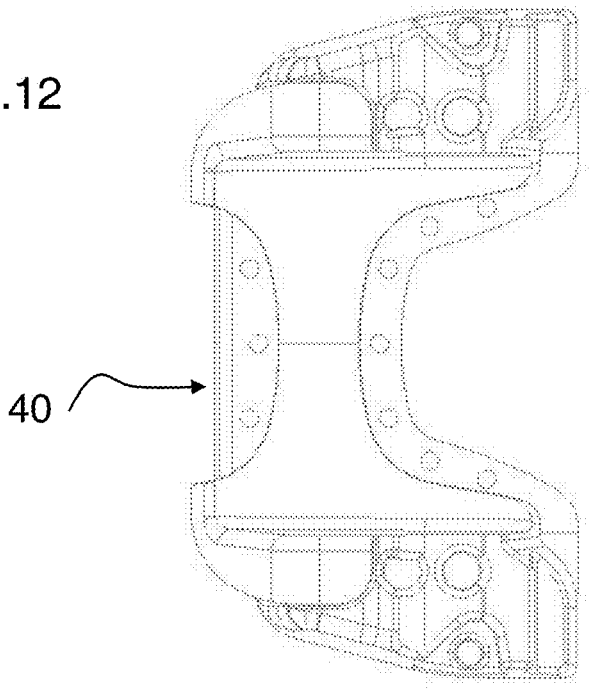

FIGS. 11 and 12 respectively depict a perspective view from above and a view from above of a third component forming a sole-reinforcing piece to support the connecting pin that connects with a binding according to an alternative form of the embodiment of the invention.

In the description that follows, the vertical direction denotes the down-up direction, namely from the sole of the shoe towards the top of the shoe. Thus, the term "underside of the sole" will denote the lower surface of the sole, visible from the outside of the shoe and intended to come into contact with the ground or with a ski, the term "top side of the sole" conversely denoting the upper surface of the sole, facing towards the inside of the shoe. The longitudinal direction denotes the direction perpendicular to the vertical direction, oriented from the rear towards the front of the shoe (and of the sole). The transverse direction is the direction perpendicular to the longitudinal direction in the plane of the sole. The two, longitudinal and transverse, directions define a horizontal plane in which the sole of a shoe more or less lies when at rest.

In the various embodiments, the same references are used to denote the same features or features that are similar.

Figure 1:
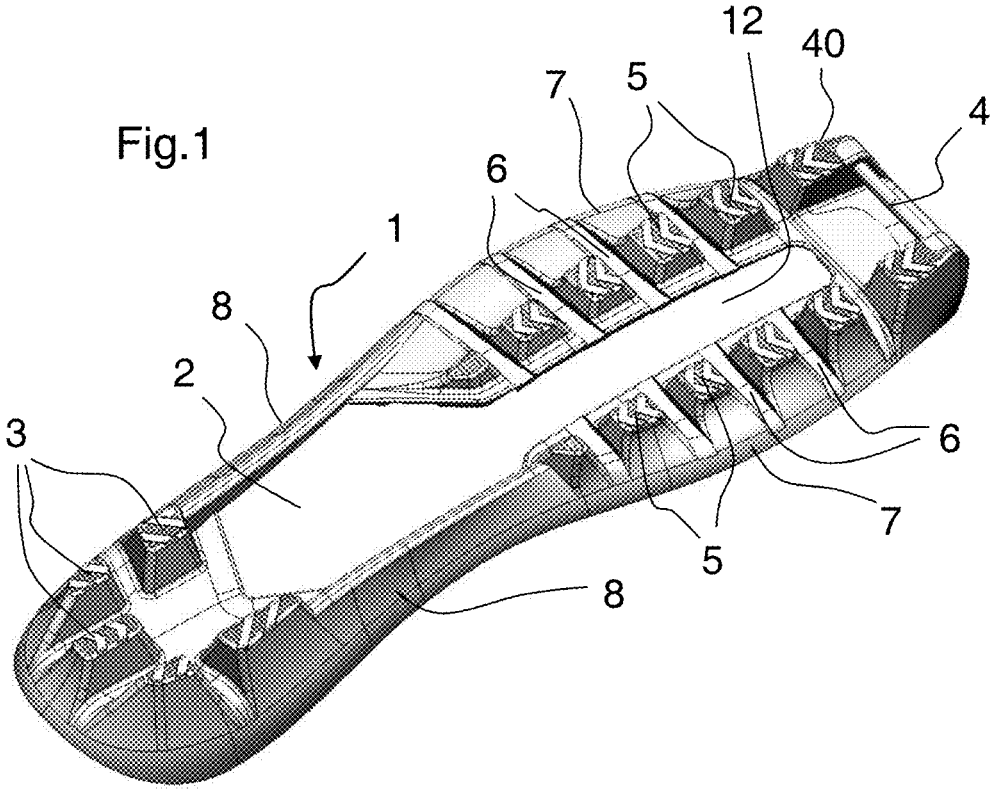
Figure 2:
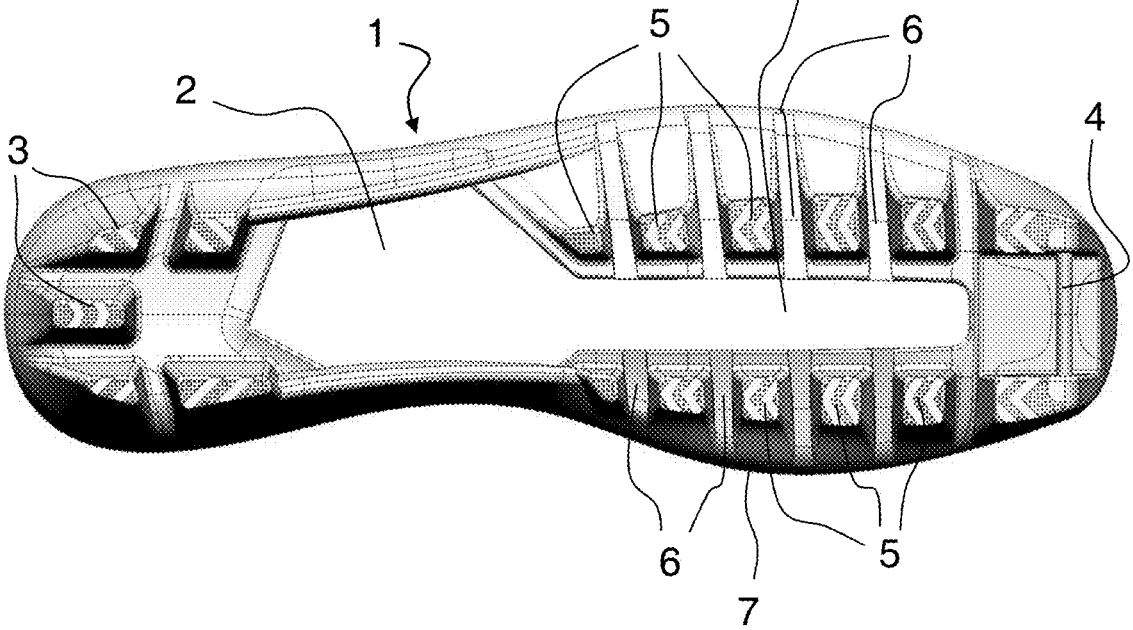
Figure 8:
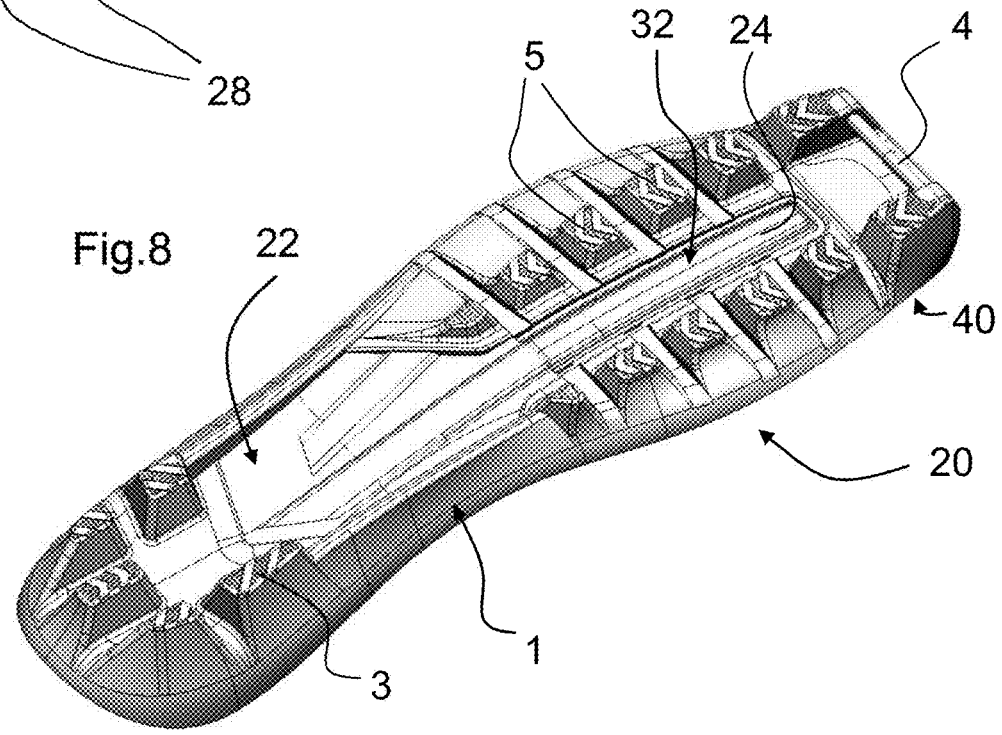
FIG. 8 depicts a perspective view from beneath of the sole according to the embodiment of the invention.
Figure 9:
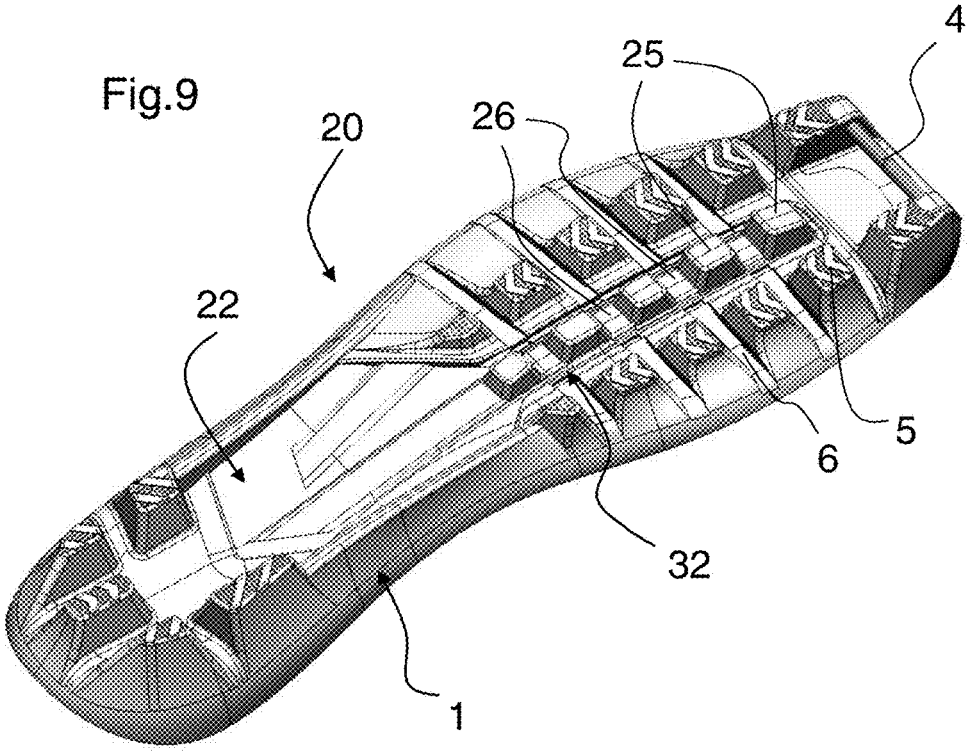
FIG. 9 depicts a perspective view from beneath of the sole according to the alternative form of the embodiment of the invention.

FIGS. 8 and 9 illustrate perspective views from beneath of a cross-country ski boot sole 20 according to one embodiment of the invention. According to this embodiment, the sole is made up of two distinct main components which are assembled. FIGS. 1 and 2 illustrate the first component 1, that forms a framework of the sole. FIGS. 3 to 7 illustrate the second component 21 of the sole.

FIGS. 1 and 2 thus illustrate a first component 1 forming a framework of a sole 20 according to the embodiment. This framework forms the entirety of the sole 20 with the exception of openings 2, 12 in the central part which are intended to accept the second component 21, as will be explained hereinafter. This framework 1 extends over the entire length of the sole 20. It notably forms the entire contour of the sole 20. Thus it forms the heel of the sole 20, comprising a few studs 3 in a conventional layout. It then comprises an anterior part forming a support for a connecting pin or bar 4 oriented transversely and allowing connection with a binding, such as a standardized binding. Finally, to the rear of this pin 4 the anterior part of the framework comprises two lateral parts 7 delimited by a longitudinal central opening 12 which extends towards the wider central/rear opening 2 situated further towards the rear, approximately in the rear part of the sole. These two lateral parts 7 each comprise a succession of anterior studs 5 which are more or less aligned in the longitudinal direction and delimited by grooves 6. The anterior studs 5 and transverse grooves 6 of the two lateral parts are aligned on either side of the longitudinal central opening 12. In particular, the central/rear opening 2 is positioned between the rear studs 3 and the front studs 5.

The framework is advantageously formed from a plastic, such as a polyurethane for example, or from Pebax® (polyether block amide) with a hardness of between 50 and 70 Shore D. It is preferably made of a single material in order to reduce costs, but it would not constitute departure from the scope of the invention for it to be made up of several materials. In particular, the heel zone may be made from another material for example. It is advantageously manufactured in an injection moulding step. It makes it possible to guarantee comfortable use of the shoe and contributes to the flexural, torsional and lateral flexural mechanical properties of the sole. Moreover, this framework may comprise two longitudinal ribs 8 forming a reinforcement, extending on each side of the central/rear opening 2, chiefly for enhancing the torsional stiffness of the sole. FIGS. 3 to 7 illustrate a second component 21 of the sole 20, which is intended to be assembled with the first component 1 described hereinabove, notably at the openings 2, 12 thereof. This second component 21 has the function of affording the stiffness/flexibility required for the sole overall, in order to achieve good performance during the practice of skiing. For that, it will preferably be made from a different material from that of the framework. In the context of skate style skiing it is preferably made from a stiffer material, thus limiting the flexure of the sole 20, notably in the anterior part. For "classic style" skiing it is preferably made of a softer material or a material of a stiffness similar to that of the framework in order to create a flexural zone in the anterior part of the sole chiefly in the region of the metatarsal joints. For example, the second component 21 may be made of a plastic, such as a polyurethane or Pebax® (polyether block amide) with a hardness of between 50 and 70 Shore D. As an alternative, it may be made of a fibre reinforced plastic material or a composite material. As an alternative, it may be fully or partially made of metal. The second component 21 is preferably formed wholly from the same material, for the sake of simplicity, but may as an alternative comprise several materials and achieve the stiffness/flexibility properties desired.

Figure 3:
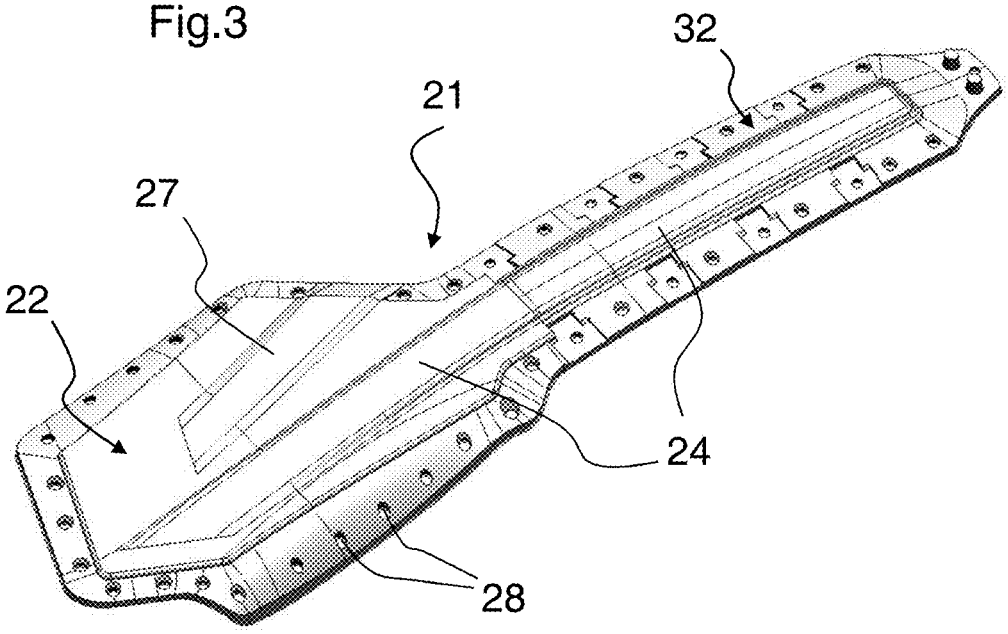
Figure 4:
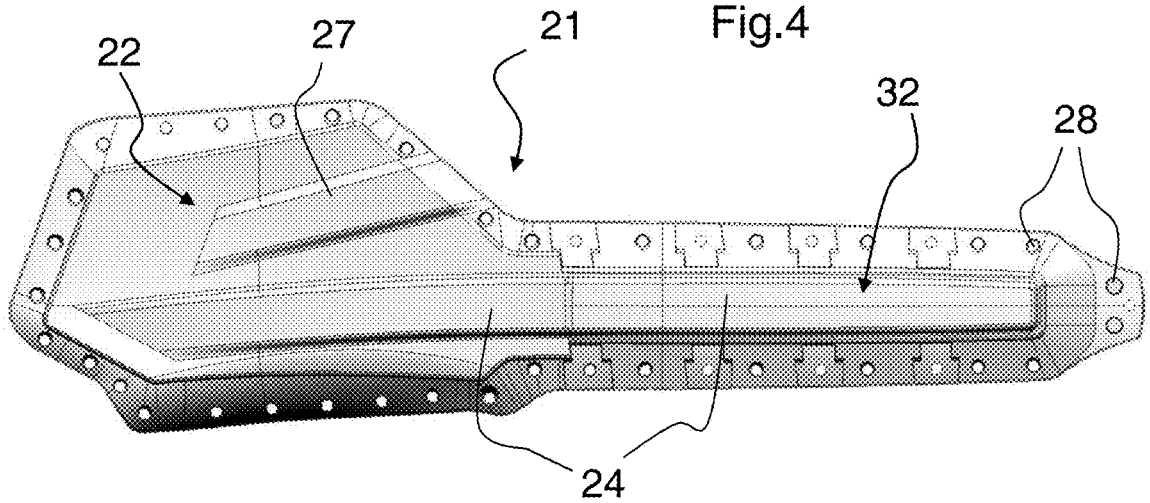

FIGS. 3 and 4 illustrate the second component 21 of the first embodiment which corresponds to a component more particularly suited to skate style skiing.

This second component 21 comprises a rear part 22 of large surface area, acting like a reinforcing plate, intended to occupy the substantially central and/or rear opening 2 of the sole. In this region, the rigid second component 21 is intended to occupy a significant area of the surface of the finished sole 20, extending over more than half the width of the sole, in order to perform a function of providing torsional stiffness of the sole.

Next, it comprises an anterior part 32 of small width, which extends in the longitudinal direction, which is intended to occupy the longitudinal central opening 12 of the framework 1 between the lateral studs 5 of the framework. This anterior part 32 behaves like a central reinforcing beam in the front part of the sole 20, where it more particularly offers resistance to bending. Naturally, this anterior part 32 of the second component 21 of the sole 20 may adopt other shapes (when viewed from above) than the shape depicted, notably comprising all or some of the following features:

- an elongate overall shape, with a constant average width, or a width narrower towards the front than towards the rear;
- a rectangular or triangular shape;
- a shape with sides that are rectilinear or curved and may or may not be parallel.

This second component 21 makes it possible to obtain a sole 20 depicted in FIG. 8 after it has been associated with the framework 1 illustrated in FIGS. 1 and 2.

The two, rear 22 and anterior 32, parts may be formed by the same component or as two different components assembled with one another, for example by adhesive bonding.

According to the embodiment, the second component 21 incorporates at least one longitudinal rib 24 to create a reinforced zone. This rib extends at least partially into the anterior part 32 and preferably approximately over the entire length of this anterior part 32. This rib has a width of between 5 and 15 mm, preferably 10 mm. This rib is in relief by 1 to 4 mm approximately, but is always set back from the underside surface of the lateral studs 5, this central part not coming into contact with the binding or with the ski. According to the alternative form of embodiment, this same rib also extends continuously in the rear part 22 of the second component 21. The rib 24 is preferably of non-constant height, measured in relation to the flat surface of the insert, depending on the stiffness desired for this zone. For example, the anterior part of the rib could be of a height greater than the rear part of the rib, and vice versa. For example, a height of 1 to 2 mm in the rear part, and of up to 3 to 4 mm in the anterior part of this rib. In an alternative form, the height of the rib 24 could be constant over the entire length of the rib. The second component 21 additionally incorporates a second rib 27 in its rear part 22, visible notably in FIG. 7, of a height h measured with respect to the flat surface of the second component 21, of between 1 to 5 mm, in order to increase the torsional stiffness in the central/rear part of the sole. Of course, other configurations of ribs in the rear part 22 may be chosen without departing from the scope of the invention, particularly as regards the number of them, their dimensions and/or their orientations with respect to the longitudinal axis.

Figure 5:
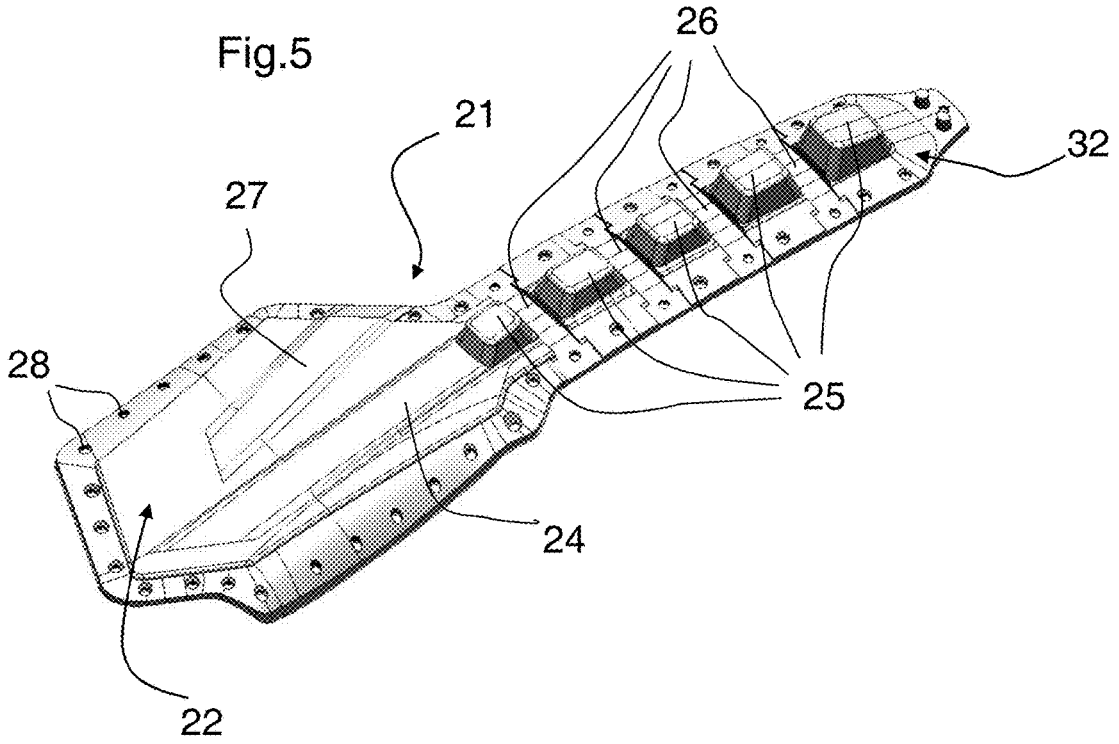
Figure 6:
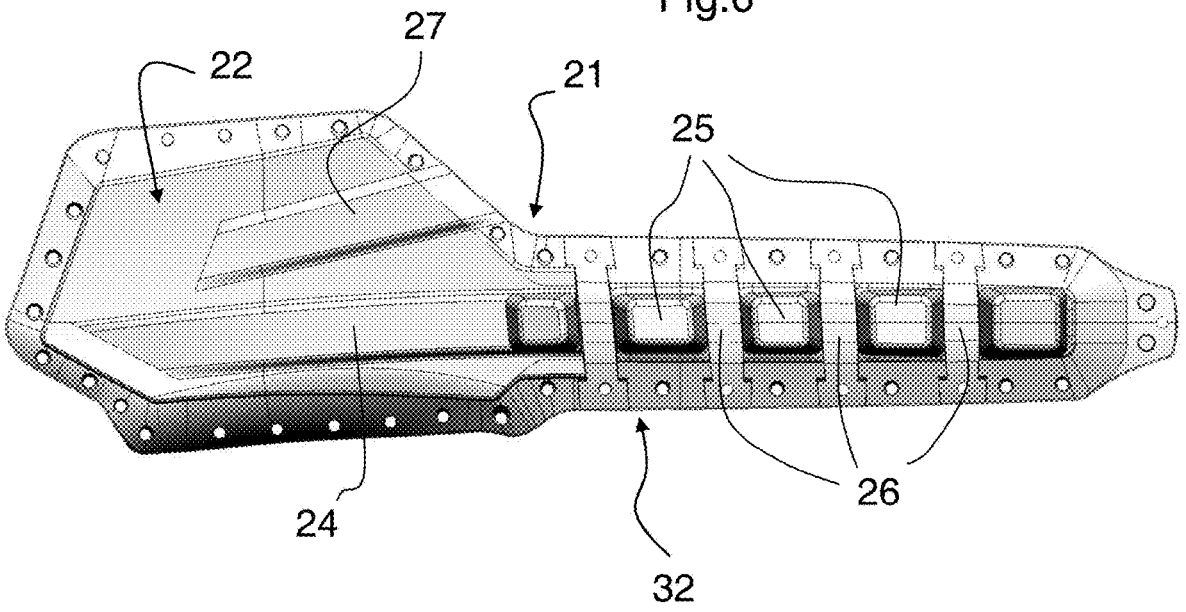
Figure 7:
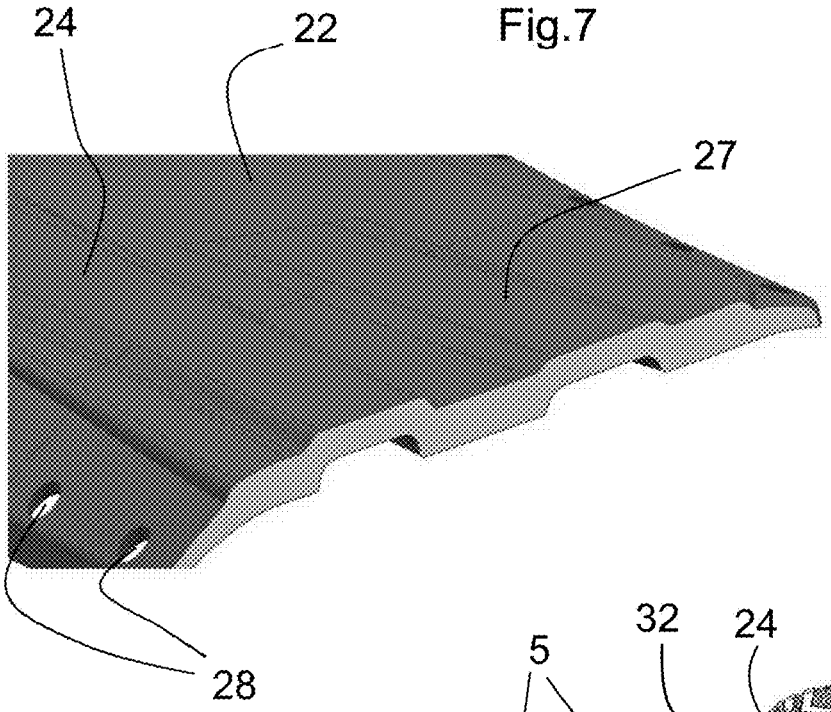
FIG. 7 depicts a view in section of the rear part of the second component forming an insert according to the alternative forms of the embodiment of the invention.

FIGS. 5 and 6 depict a second component 21 according to an alternative form of embodiment. It differs from the second component 21 described hereinabove in that its anterior part 32 does not have a continuous rib but has studs 25. These studs are aligned in the longitudinal direction and there are 5 of them here, although the number of them could be lower. The second component 21 makes it possible to obtain a sole 20, depicted in FIG. 9, after it has been associated with a framework 1 as described previously in conjunction with FIGS. 1 and 2. According to this alternative form, the anterior part 32 bears the studs 25, separated by transverse grooves 26. These studs have a lower surface that reaches the same level as the studs of the framework on the finished sole, the purpose of this being so as to come into contact with the plate of the binding and/or the ski. This studded region 25 may extend over a length similar to that of the zone covered by the studs 5, or possibly over a more restricted length. According to this alternative form the material used for the second component 21 is not as stiff as the material used for the first component 1, thus improving the flexing of the sole 20, notably in the anterior part and particularly in the metatarsal region. In another alternative form, the second component 21 and the first component 1 may have equivalent stiffness (and/or hardness). As in the first embodiment, the rear part 22 of the second component 21, the width of which is greater than that of the anterior part 32, may also have reinforcing ribs 24, 27 (visible in FIG. 7) to increase the torsional stiffness of the sole. In particular, a rib 24 may extend in the continuation of the series of studs 25.

The sole according to this alternative form of embodiment is preferably intended for a traditional or "classic style" cross-country skiing.

This second component 21, for both alternative forms of embodiment, may be manufactured by any means. For example, it may be manufactured by injection of plastic in an embodiment made from plastic.

In any case, the studs 3, 5, 25 of the two components 1, 21 may be formed at the same time as the component that incorporates them, thus forming a monolithic entity with the said component, or may be formed separately in a separate step. In the latter instance, that offers the advantage that a material other than that used for the two components described hereinabove can be used, notably a very soft material particularly suited to deadening impacts, encouraging walking and/or avoiding slippage. In the preferred embodiment, each component 1, 21 forms the base of the studs, which is then covered with a soft material, of rubber and/or non-slip type. It is also possible to use a polyurethane with a hardness of between 40 and 60 Shore D. For that, the manufacturing method may comprise an additional step of injection moulding of plastic on the sole obtained by the assembling of the two components described, so as to form the surface coating of the studs. Moreover, the coating may extend beyond the surface of the studs and cover all or part of the insert and/or of the framework.

Figure 10:
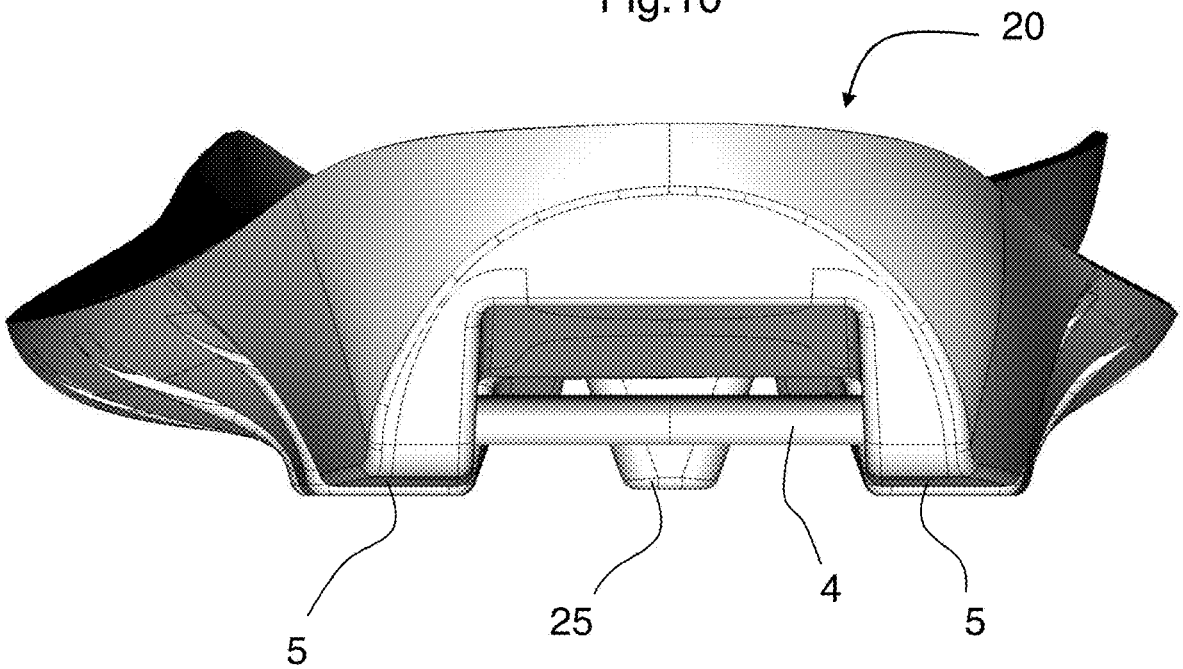
FIG. 10 depicts a head-on view from the front of the sole according to the embodiment of the invention.

FIGS. 8 to 10 depict the finished sole 20, formed by the assembly of the two components 1, 21 described hereinabove. These two components may be manufactured separately and then assembled by any means, mechanical or otherwise, such as adhesive bonding. According to one preferred embodiment, the second component 21, manufactured beforehand in a first injection in a specific first mould, is then placed in a sole-manufacturing mould to form the framework during a second injection in this second mould. The framework is then secured to the second component during this second injection, to form the sole. Using this approach, the second component forms an insert and the sole is obtained by overmoulding the first component around and over this insert. This way of manufacturing the sole guarantees that the two components are secured together firmly, while at the same time representing a method that is inexpensive because it does not require a separate step of fixing the two components together. In order to increase the secure attachment of the two components to one another, the second component forming the insert comprises several through-holes 28 arranged around its periphery, in a zone that will be covered on its two, lower and upper, surfaces with the injected material that forms the framework, this adding mechanical attachment of the two components to one another. In this peripheral zone, the framework 1 is overmoulded over the insert (second component 21), and the material thereof passes through the through-holes 28 of the insert.

Moreover, in the front part of the sole, it is known practice to use a reinforcing piece 40 to support the connecting pin 4 that connects with a binding, as depicted in FIGS. 11 and 12. The use of this reinforcing piece guarantees correct retention of the connecting pin 4 irrespective of the choice of materials for the framework or for the second component. The reinforcing piece 40 is substantially U-shaped or V-shaped. This reinforcing piece is manufactured by injection moulding, independently of the injections used to create the components of the invention. For that, a rigid plastic material is injected to enclose the connecting pin 4 at its two ends. The material used may be a polyurethane with a hardness of between 50 and 70 Shore D. If the connecting pin 4 is also U-shaped, the lateral branches of the pin may be embedded in the lateral parts 7 of the framework. This reinforcing element 40 bearing the connecting pin 4 is then positioned in the mould used to manufacture the sole at the same time as the second component 21, then the material intended to form the first component 1 is injected into the mould to form the sole 20. This reinforcing piece 40 thus allows the sole to be stiffened in this part bearing the connecting pin 4 so as to withstand the loads associated with connection to the ski binding.

FIGS. 8 to 10 therefore depict the sole obtained by assembling the two components 1, 21 described hereinabove. The proposed architecture makes it possible to achieve a compromise between flexibility and comfort, and the stiffness required for good skiing. As explained in the foregoing examples, the materials are chosen to achieve the desired mechanical properties. Note that the stiffness, notably the flexural and/or torsional stiffness, is given particular consideration, as described in detail hereinabove. In the case of plastics materials, the hardness is the parameter considered to be representative of this stiffness and/or of the other mechanical properties mentioned, according to the routine practice of those skilled in the art.

In particular, the anterior part 32 of the second component 21 makes it possible to adjust the optimal flexing of the sole. To do that, this anterior part 32 extends forward substantially from the centre C of the sole. Advantageously, it extends approximately as far as the connecting pin 4 situated at the front end of the sole. Advantageously, it extends over a length greater than or equal to one quarter, or even one third, of the total length of the sole. It extends between the two lateral parts 7 of the first component 1. Thus, it extends between the two rows of lateral anterior studs 5 of the sole. As an alternative, it is possible for it to extend only partially between the anterior studs 5. These studs may have some other configuration: they may be fewer in number, in which case the furthest-back stud is not necessarily located right at the centre C of the sole. Its width is constant or, as an alternative, variable. It is advantageously of a mean width of between 10 and 25 mm, preferably close to 20 mm.

The studs 5, 25 of the sole 20 are all aligned in the transverse direction, as are the grooves 6, 26: that encourages and guides correct flexing of the sole.

The rear part 22 of the second component 21 occupies a significant area which extends over practically the entire width of the sole. It extends rearward from substantially the centre C of the sole. Advantageously, it extends over at least one quarter of the total length of the sole. It in particular acts as a torsional stiffener. Thus, the boundary between the rear part 22 and the anterior part 32 of the second component 21 is substantially positioned at the centre C of the sole 20. As an alternative, this boundary may be set forward or back slightly. In any case, the second component 21 comprises an anterior part 32 extending substantially longitudinally into the anterior part of the sole 20.

Thus, the sole obtained by combining the two components according to the invention has high stiffness properties, in torsion and in bending, for the practice of skate style skiing, making it possible to achieve a maximum transfer of energy from the foot to the ski during propulsion. The sole obtained for "classic style" skiing has torsional stiffness properties which remain high and similar to the sole intended for skate style skiing, but is more flexible in terms of flexural bending at the front of the foot, in order to facilitate the back and forth rearward movement, thus allowing the foot a good rolloff and good drive.

In order to reduce manufacturing costs and offer soles suited to the two practices of cross-country skiing referred to as classic style and skate style skiing, the approach adopted according to the invention allows the architecture of the sole to be adapted simply by modifying the second component 21, the framework remaining unchanged. Thus, the same mould for manufacturing the sole, and, more particularly, the framework, is used in both instances, only the insert mould being slightly modified.

The invention also relates to a sports shoe, notably a cross-country ski boot, comprising a sole as described hereinabove. It also relates to a series of shoes comprising at least two soles that differ only in terms of the second component, their first component being identical, at least in terms of shape, and preferably in terms of identical shape and identical material. As has been described, the invention is particularly suited to use for a cross-country ski sole. However, there is nothing to prevent it being used for some other sport.

Finally, the invention also relates to a method of manufacturing a sole of a shoe, and more generally a sports shoe, which comprises the steps described hereinabove.

Naturally, the invention is not restricted to the embodiment and alternative forms thereof described. Notably, the sole may comprise more than two components, as was seen according to the last alternative form of embodiment. As an alternative, the heel may also be formed as a separate component. The framework and/or the second component may be formed by assembling several parts, or may be monolithic as described hereinabove. Furthermore, the attachment of the second component to the framework may be removable or nonremovable, as described hereinabove by the overmoulding method. In the case of a removable second component, it is possible easily to modify the properties of the sole of a sports shoe simply by changing the second component, notably to switch from a cross-country ski boot suited to classic style skiing to one suited to skate style skiing and vice versa. According to another alternative form, the entire sole may be removable in order to allow soles with different properties to be fitted to the same boot upper.

Finally, the solution according to the invention therefore offers the following advantages: this allows the manufacture of a sole that is lightweight, of low cost, which combines comfort and stiffness properties, notably properties of flexural and torsional stiffness. It therefore does indeed achieve the desired objectives.

The invention claimed is:

1. A sole for a sports shoe, comprising:

a first component acting as a framework extending from a heel area of the sole in a rear part of the sole to an anterior part of the sole and defining an opening in the first component, wherein the first component comprises two lateral parts extending in the anterior part of the sole, and wherein the opening extends in the rear part of the sole and in the anterior part of the sole between the two lateral parts of the first component, and at least one second component arranged at least partially in the opening and assembled with the first component, wherein the second component comprises a rear part and an anterior part, the rear part of the second component extending at least partially in the rear part of the sole and the anterior part of the second component extending substantially longitudinally in the anterior part of the sole between the two lateral parts of the first component, wherein a width of a maximum width part of the rear part of the second component is greater than a width of a maximum width part of a remainder of the second component including the anterior part of the second component extending in the anterior part of the sole, and wherein the first component of the sole attaches to a gliding board of the cross-country ski type with a transverse connecting pin situated near an anterior end of the sole.

2. The sole for a sports shoe according to claim 1, wherein the anterior part of the second component of the sole extends at least partially between two lateral rows of anterior studs of the first component of the sole.

3. The sole for a sports shoe according to claim 1, wherein the anterior part of the second component of the sole exhibits at least one of the following additional features:

the anterior part of the second component of the sole has an elongate overall shape, wherein the anterior part of the second component of the sole has either a constant average width or a width narrower towards the front than towards the rear;

a shape of the anterior part of the second component of the sole is rectangular or triangular;

sides of the anterior part of the second component of the sole are rectilinear or curved and the sides are parallel or not parallel.

4. The sole for a sports shoe according to claim 1, wherein the anterior part of the second component of the sole comprises at least one selected from the group consisting of (i) a rib extending over all or part of a length of the anterior part of the second component of the sole, and (ii) a row of studs aligned in a transverse direction with lateral anterior studs of the first component.

5. The sole for a sports shoe according to claim 1, wherein the rear part of the second component comprises at least one rib.

6. The sole for a sports shoe according to claim 1, wherein at least one selected from the group consisting of (i) the first component and the second component have different hardnesses and (ii) the first component and the second component have different stiffnesses.

7. The sole for a sports shoe according to claim 1, wherein the first component of the sole forms an outline of the sole.

8. A cross-country ski boot intended for the practice of skate style skiing, comprising a sole according to claim 1, wherein the second component of the sole is made of a material having a stiffness or a hardness higher than a respective stiffness or hardness of the material of the first component.

9. A cross-country ski boot according to claim 8, wherein the anterior part of the second component has a reinforcing rib.

10. A cross-country ski boot intended for the practice of classic-style skiing, comprising a sole according to claim 1, wherein a stiffness or a hardness of material of the second component is lower than or equal to a respective stiffness or hardness of the material of the first component.

11. A cross-country ski boot according to claim 10, wherein the anterior part of the second component has studs.

12. The sole for a sports shoe according to claim 1, wherein the first component surrounds the opening.

13. The sole for a sports shoe according to claim 1, wherein the rear part of the second component extends over more than half the width of the heel part of the sole.

14. The sole for a sports shoe according to claim 1, wherein the anterior part of the second component extends in a central longitudinal position relative to the sole.

15. The sole for a sports shoe according to claim 1, wherein the anterior part of the second component has a mean width of between 10 and 25 mm.

16. The sole for a sports shoe according to claim 1, wherein a front part of the sole has a substantially U-shaped or V-shaped reinforcing piece that supports the transverse connecting pin that connects with a binding.

17. A series of cross-country ski boots, comprising at least first and second cross-country ski boots, wherein:

the first cross-country ski boot, intended for the practice known as classic-style skiing, comprises a first sole which is the sole according to claim 1, in which the anterior part of the second component of the first sole comprises a row of studs, the second cross-country ski boot, intended for the practice of skate style skiing, comprises a second sole comprising a first component and a second component arranged at least partially in an opening of the first component and assembled with the first component, the second component comprising a rear part and an anterior part, the rear part of the second component extending at least partially in a rear part of the second sole and the anterior part of the second component extending substantially longitudinally in an anterior part of the second sole between two lateral parts of the anterior part of the first component of the second sole, in which the anterior part of the second component of the second sole does not have studs, and wherein the first components of the first and second soles are identical.

18. A method of manufacturing a sole of a sports shoe, comprising:

manufacturing a second component;

manufacturing a first component;

assembling the first and second components, so that the second component comprises an anterior part which extends substantially longitudinally in the anterior part of the sole, so as to obtain the sole according to claim 1.

19. The method of claim 18, wherein the assembling of the two components is obtained through overmoulding of the first component on the second component placed in an injection mould.

* * * * *